US007849867B2

(12) United States Patent
Takayama

(10) Patent No.: US 7,849,867 B2
(45) Date of Patent: Dec. 14, 2010

(54) LOCKING DEVICE FOR A TENT

(75) Inventor: Toshihiko Takayama, Kyoto (JP)

(73) Assignee: San-E-Protent Co., Ltd., Kyoto (JP)

( * ) Notice: Subject to any disclaimer, the term of this patent is extended or adjusted under 35 U.S.C. 154(b) by 107 days.

(21) Appl. No.: 12/246,677

(22) Filed: Oct. 7, 2008

(65) Prior Publication Data

US 2009/0120480 A1 May 14, 2009

(30) Foreign Application Priority Data

Nov. 12, 2007 (JP) ..... 2007-293239

(51) Int. Cl.
*E04H 15/60* (2006.01)

(52) U.S. Cl. ..... 135/114

(58) Field of Classification Search ..... 135/114, 135/120.1, 120.2; 403/109.1, 109.2, 109.3
See application file for complete search history.

(56) References Cited

U.S. PATENT DOCUMENTS

| | | | | |
|---|---|---|---|---|
| 6,032,914 | A * | 3/2000 | Bastida | 248/354.1 |
| 6,551,226 | B1 * | 4/2003 | Webber et al. | 482/148 |
| 6,575,656 | B2 * | 6/2003 | Suh | 403/109.6 |
| 7,040,832 | B2 * | 5/2006 | Hsieh | 403/109.3 |
| 7,395,830 | B2 * | 7/2008 | Seo | 135/140 |
| 7,409,963 | B2 * | 8/2008 | Mallookis et al. | 135/144 |
| 2006/0062632 | A1 * | 3/2006 | Jang | 403/109.6 |
| 2007/0012346 | A1 * | 1/2007 | Choi | 135/114 |

FOREIGN PATENT DOCUMENTS

| | | |
|---|---|---|
| JP | 8-9938 | 1/1996 |
| JP | 2504766 | 4/1996 |
| JP | 10-088949 | 4/1998 |
| JP | 3123507 | 6/2006 |
| JP | 3133263 | 6/2007 |

* cited by examiner

*Primary Examiner*—David Dunn
*Assistant Examiner*—Noah Chandler Hawk
(74) *Attorney, Agent, or Firm*—Griffin & Szipl, P.C.

(57) ABSTRACT

A locking device for a tent comprises a pole 2, a lock base 3 installed to allow hoisting/lowering of the pole, a lock hole 4 provided the pole, and a lock pin 5, provided movably within the lock base in the longitudinal direction, thus enabling the lock pin to be in a locking position to allow it enter the lock hole, or to be retracted to an unlocking position, to allow the lock pin to disengage from the lock hole. An elastic body 6 pushes the lock pin towards the locking position all the time. An operating lever 7 provided on the lock base can move the lock pin to an unlocking position; a coming-off prevention and holding means 8 allows the lock pin to be placed in a safety position for preventing accidental unlocking.

3 Claims, 5 Drawing Sheets

LOCKING DEVICE FOR A TENT

This application claims priority from Japanese Patent Application No. 2007-293239, filed Nov. 12, 2007, the disclosure of which is hereby incorporated by reference.

TECHNICAL FIELD OF THE INVENTION

The present invention relates mainly to improvements in a locking device for a tent to be used between a pole and a beam and also between an outer pipe and an inner pipe.

BACKGROUND OF THE INVENTION

A locking device to which the present invention is directed has been disclosed, for example, in the below-listed patent documents 1 to 5. The locking device principally comprises a pole, a lock base that can slide along the pole, a lock hole provided in the pole, a lock pin provided movably to a lock base in the longitudinal direction of the lock pin, thus enabling the lock pin to engage the lock hole in a locking position and also to disengage the lock hole in an unlocking position, an elastic body to push the lock pin mounted on the lock base toward the locking position all the time, and an operating lever provided on the lock base to move the lock pin to the unlocking position. With such a device, a relative hoisting/lowering motion of the pole and the lock base is prevented after the lock hole and lock pin come into alignment by a relative hoisting/lowering of the pole and the lock base, because the lock pin enters the lock hole with the help of an elastic body to place the locking pin in the locking position. From such a state, when the operating lever pushes against the elastic body, the lock pin moves out of the lock hole and is placed in the unlocking position; thus, a relative hoisting/lowering of the pole and the lock base is permitted.

Patent Document 1 Japanese Utility Model Registration No. 2504766

Patent Document 2 Japanese Unexamined Patent Application No. 8-9938

Patent Document 3 Japanese Unexamined Patent Application No. 10-88949

Patent Document 4 Japanese Utility Model Registration No. 3123507

Patent Document 5 Japanese Utility Model Registration No. 3133263

SUMMARY OF THE INVENTION

In the devices disclosed previously, a relative hoisting/lowering of the pole and the lock base is allowed when the operating lever is wrongly manipulated, thus causing unexpected accidents and not being able to ensure the safety of the device.

It is an object to provide a locking device for a tent in which the disadvantages described above are overcome, that is, an relative hoisting/lowering of the pole and the lock base is not allowed when the operating lever is wrongly manipulated, thus avoiding unexpected accidents and enhancing the safety. Thus, in accordance with a first embodiment of the present invention, a locking device for a tent is provided that includes: (a) a pole, (b) a lock base installed hoisting/lowering-allowably relative to the pole, (c) a lock hole provided with the pole, (d) a lock pin provided movably to the lock base in the longitudinal direction, thus enabling it to make a locking position to allow it to enter the lock hole and also to make an unlocking position to allow it to move away from the lock hole, (e) an elastic body to push the lock pin mounted on the lock base to the locking position all the time, (f) an operating lever provided slideably on the lock base to move the lock pin to the unlocking position, and (g) a coming-off prevention and holding means which allows the lock pin to be placed at the locking position for coming-off prevention and holding. In accordance with a second embodiment of the present invention, the first embodiment is modified so that the pole is provided with an outer pipe and an inner pipe to be fitted therein, a lock base fixed to the outer pipe, a lock hole is mounted on the inner pipe, and a through hole through which the lock pin passes is provided on the outer pipe. In accordance with a third embodiment of the present invention, the first embodiment is modified so that the coming-off prevention and holding means is installed between the lock base and the lock pin, wherein the lock pin is moveable in the longitudinal direction to the lock base and also pivotally about the axis in the longitudinal direction, and a rotation operating body is provided on the lock pin so that operation of rotation becomes possible from outside, and a rotation regulating mechanism is provided between the lock pin and the lock base with which the lock pin can be placed either at a coming-off prevention capable position or a coming-off prevention incapable position by regulating the rotation of the lock pin, and a coming-off prevention mechanism is provided between the lock pin and the lock base, wherein the coming-off prevention mechanism prevents the lock pin from moving in the longitudinal direction when the lock pin is at the coming-off prevention capable position and also allows the lock pin to move in the longitudinal direction when the lock pin is at the coming-off prevention incapable position. In accordance with a fourth embodiment of the present invention, the third embodiment is further modified so that the rotation regulating mechanism is provided with an oval shaped brim piece made on the lock pin, and a contacting piece made on the lock base, which makes contact with the end surface of the brim piece when the lock pin is at the coming-off prevention capable position and at the coming-off prevention incapable position, and the coming-off prevention mechanism is provided with the brim piece of the rotation regulating mechanism and a coming-off prevention piece mounted on the lock base, which allows the lock pin to make contact with the brim piece when the lock pin is at the coming-off prevention capable position and prevents the making of contact with the brim piece when the lock pin is at the coming-off prevention incapable position. In accordance with a fifth embodiment of the present invention, the second embodiment is further modified so that an outer pipe side sliding body is provided to slideably guide an inner pipe on the lower part of the outer pipe, and the lock base is removably fitted on the lower part of the outer pipe by means of an outer pipe sliding body.

MEANS TO ACHIEVE THE OBJECT

A locking device for a tent, in accordance with the present invention, comprises a pole, a lock base that can move along the pole, a lock hole provided on the pole, a lock pin provided movably to the lock base in the longitudinal direction of the lock pin, thus enabling the lock pin to have a locking position to allow it to enter the lock hole and also to have an unlocking position to allow it to move out of the lock hole, an elastic body to push the lock pin mounted on the lock base towards the locking position all the time, an operating lever rotatably mounted on the lock base to move the lock pin to the unlocking position, and a coming-off prevention and holding means which allows the lock pin to be placed at a locking position for coming-off prevention and holding (locked safety position), wherein accidentally pressing the operating lever will not move the lock pin from the locking position to the unlocking position.

When the lock hole and the lock pin come into alignment as the pole and the lock base are moved relative to each other, the lock pin enters the lock hole with the help of the elastic body, whereby the lock pin is placed in the locking position and further relative hoisting/lowering of the pole and the lock base is prevented. When the operating lever is pressed, the lock pin moves away from the lock hole into the unlocking position, and a relative hoisting/lowering of the pole and the lock base is allowed. When the coming-off prevention and holding means is actuated, the lock pin is held at the locking position for the coming-off prevention (locked safety position). Therefore, even if the operating lever is accidentally pressed so that the lock pin would otherwise be placed at an unlocking position, a relative hoisting/lowering of the pole and the lock base is prevented due to the reason that the lock pin is held at the locking position for coming-off prevention (locked safety position) by the coming-off prevention and holding means.

The pole is provided with an inner pipe and an outer pipe into which the inner pipe is slideably inserted. The lock base is fixed to the outer pipe, and the lock hole is made in the inner pipe. It is desirable that a through hole through which the lock pin passes is provided in the outer pipe. In such a manner, the locking device can engage the holes in both the outer and inner pipes of the pole of a tent.

A coming-off prevention and holding means is installed between a lock base and a lock pin. It is desirable that the lock pin is not only movable axially in the longitudinal direction relative to the lock base, but also pivotally about the axis of the longitudinal direction. A rotation operating body (such as a knob) provided on the lock pin allows rotation from outside, a rotation regulating mechanism provided between the lock pin and the lock base with which the lock pin can be placed either in the coming-off prevention capable position (locked safety position) or a coming-off prevention incapable position (operational orientation) by regulating the rotation of the lock pin. The coming-off prevention mechanism provided between the lock pin and the lock base ensures that the movement of the lock pin in the longitudinal direction is prevented when the lock pin is placed in the coming-off prevention capable position (locked safety position), but the movement of the lock pin in the longitudinal direction is allowed when the lock pin is placed at a coming-off prevention incapable position (operational orientation). In such a manner, it becomes possible that the simplified structure results in both cost and space savings with a coming-off prevention and holding means which can be constituted by making use of a lock pin.

A rotation regulating mechanism is provided with a near oval shaped brim piece mounted on the lock pin and a rotational stop installed on the lock base which makes contact with the brim piece when the lock pin is placed in the coming-off prevention capable position (locked safety position) and also when placed in the coming-off prevention incapable position (operational orientation), and it is desirable that a coming-off prevention mechanism is provided with a brim piece for a rotation regulating mechanism and a coming-off prevention piece mounted on the lock base which makes contact with the brim piece when the lock pin is placed at the coming-off prevention capable position (locked safety position) and makes no contact with the brim piece when the lock pin is placed at the coming-off prevention incapable position (operational orientation). In such a manner, it becomes possible that the simplified structure by the shared use of a brim piece results in both cost and space savings.

An outer pipe side sliding body which guides an inner pipe slideably is provided at the bottom of the outer pipe, and an inner pipe side sliding body which guides the outer pipe sideably is provided at the top of the inner pipe. It is desirable that the lock base is attached removably to the lower part of the outer pipe with the outer pipe side sliding body. In such a manner, a relative movement of the outer pipe and inner pipe can be achieved smoothly, thus preventing the rattle between the outer pipe and inner pipe and allowing use of the outer pipe side sliding body when installing the lock base and outer pipe.

EFFECTS OF THE INVENTION

With the present invention, such excellent effects as stated below can be achieved. A locking device for a tent comprises a pole, a lock base, a lock hole, a lock pin, an elastic body, an operating lever, and a coming-off prevention and holding means. Among other things, the device is provided with a coming-off prevention means which allows the lock pin to be placed at a lock position for coming-off prevention and holding. Therefore, even when the operating lever is wrongly manipulated, unexpected accidents can be avoided, thus enhancing the safety.

BRIEF DESCRIPTION OF THE DRAWINGS

A preferred embodiment of the present invention is described hereinafter with reference to the following drawings.

DETAILED DESCRIPTION OF THE INVENTION

Figure 1:
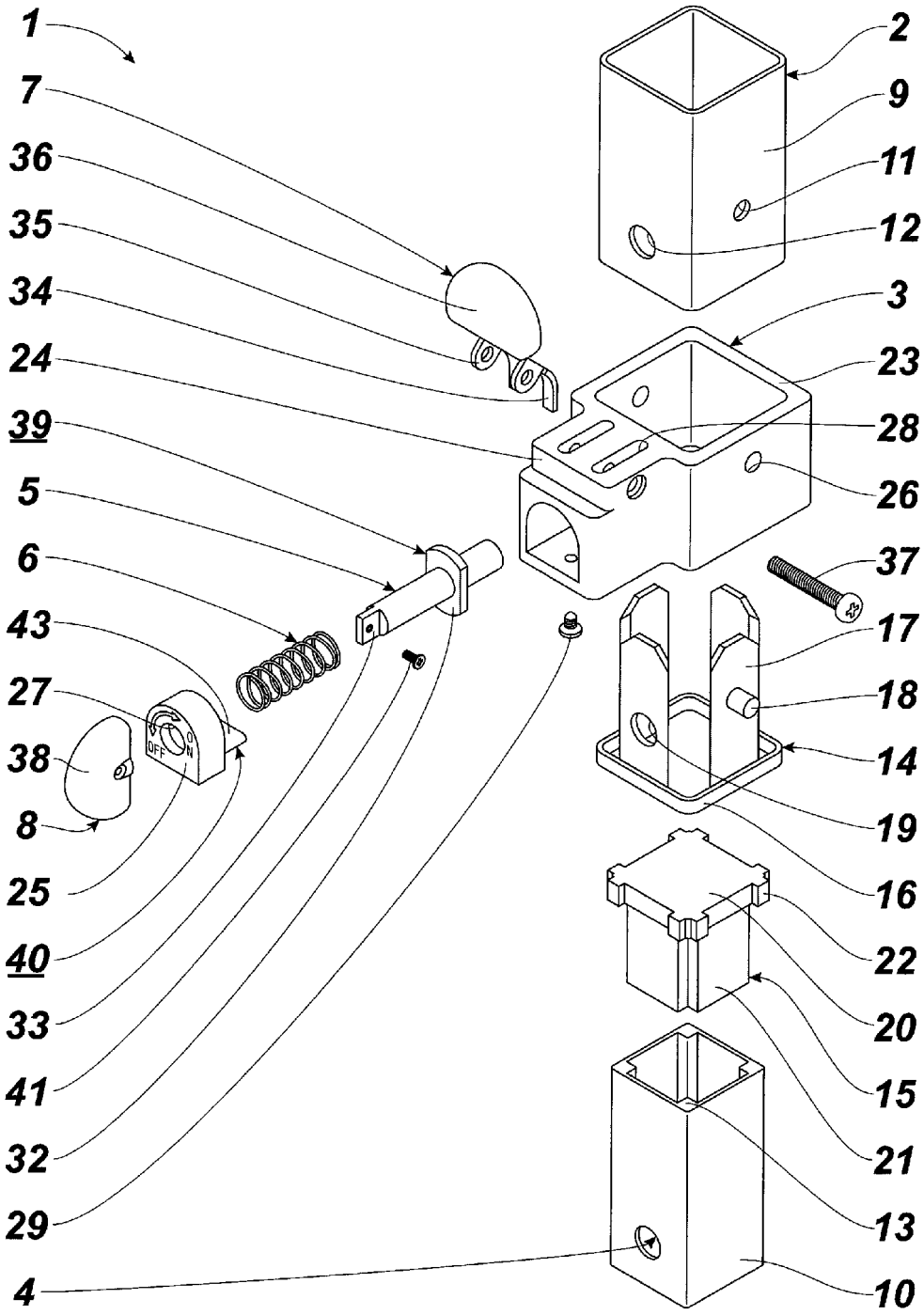
FIG. 1 is an exploded perspective view to illustrate a locking device according to the present invention.

Referring now to FIG. 1, it is so stipulated that an upper side is an upper side, a lower side is a lower side, a right upper side is a front side, a left lower side ls a rear side, a right lower side is a right side, and a left upper side is a left side.

The major portion of a locking device for a tent 1 comprises a pole 2, a lock base 3, a lock hole 4, a lock pin 5, an elastic body 6, an operating lever 7, and a coming-off prevention and holding means 8.

The pole 2 which constitutes the major portion of the locking device for a tent 1 is, with this example, made up of metal such as aluminum or the like, with a long length in the vertical direction. The pole 2 has with an outer pipe 9 and an inner pipe 10, which is slideably inserted therein. The outer pipe 9 is shaped of nearly square cross section, and on the lower part there are fitting holes 11 on the both left and right sides, and on the rear side there is made a through hole with communication to lock hole 4. The inner pipe 10 is shaped of nearly square cross section having a shorter diameter than that of outer pipe 9. On the four inside corners thereof, stiffening ribs 13 shaped of nearly square cross section are provided.

On the lower part of outer pipe 9, there is installed an outer pipe side sliding body 14 to guide slideably inner pipe 10 fitted thereto, and on the upper part of inner pipe 10, there is installed an inner pipe side sliding body 15 to guide slideably outer pipe 9 fitted thereto. A synthetic resin made outer pipe side sliding body 14 is provided with a 4-sided frame shaped frame piece 16 which makes a contact with the lower end of the outer pipe 9, 4 sliding pieces 17 slideably contacted with the outer surface of an inner pipe 10 being made on each side thereof and positioning on the inner side of the lower part of an outer pipe 9, a projection 18 fitted to a fitting hole 11 of an outer pipe 9 outwardly protruded to both left and right sliding pieces 17, and a through hole 19 made on the rear side sliding piece and with communication to a through hole 12 of an outer pipe 9. Inner pipe side sliding body 15, made of a synthetic resin, comprises a cap 20 fitted to the upper end of an inner pipe 10, an inserting piece 21 made on the under side thereof and inserted into the upper inside of an inner pipe, and eight sliding pieces 22 in total which are made on the 4 corners not to be interfered with 4 sliding pieces 17 and slideably contacting with the inner surface of outer pipe 9.

DETAILED DESCRIPTION OF THE ILLUSTRATIVE EMBODIMENTS

The lock base 3 installed to allow hoisting/lowering of pole 2 is, with this example, made of synthetic resin and fixed to outer pipe 9, and provided with a square pipe shaped pipe 23 to be outwardly fitted to outer pipe 9, a case 24 made on the rear side thereof and having a near circle shaped housing cavity with the open rear part, and a cap 25 to close the rear part thereof. On the both left and right sides of pipe 23 there is a fitting hole 26 for communication to fitting hole 11 of outer pipe 9 and to which projection 18 of outer pipe side sliding body 14 is fitted. In pipe 23 and cap 25 there are guide holes 27 to guide lock pin 5 passing through them. On the upper part of case 24 for communication to a housing cavity there are left and right insertion holes wherein operating lever 7 is to be inserted. The cap 25 is removably secured by means of fastening hardware 29 such as a screw. On the front side of guide hole 27, there is a receiving hole 30 to support one side of elastic body 6, having a larger diameter than that thereof, and on the rear surface, there are signs displayed, "ON" to show the state of coming-off prevention and holding (locked safety position), "OFF" to show the state of coming-off prevention released (operational orientation), and a "Double-headed Arrow" to indicate the direction of rotation.

The lock hole 4 in pole 2 is, with this example, made in inner pipe 10. A suitable number of lock holes are made in the longitudinal direction (up and down direction) on the rear side of inner pipe 10 with a prescribed interval, although only one hole is shown in the drawing.

The lock pin 5, installed movably in a longitudinal direction to lock base 3, is able to take a locking position in lock hole 4 and also to take an unlocking position out of lock hole 4. With this example, lock pin 5 is made of a metal such as aluminum or the like and shaped like a near circular cylinder. Lock pin 5 is axially movable relative to the guide hole 27 of lock base 3 and also pivotally moveable about the axis. On the front side of lock pin 5, there is a recess wherein a cylinder shaped sliding piece made of synthetic resin is inserted, except for the front side which protrudes. At the midpoint of lock pin 5 there is an oval shaped brim piece 32, and on the rear part of lock pin 5 there is a fitting piece 33 where both sides are cut off.

The elastic body 6 which is installed on lock base 3 pushes lock pin 5 towards the locking position all the time. In this example, a compression type coil spring made of a metal such as spring steel is used. The spring is placed around lock pin 5 from behind, and installed between brim piece 32 of lock pin 5 and receiving hole 30 of cap 25 of lock base 3, thus lock pin 5 is pushed towards the front side (towards lock hole 4) all the time.

In this example, the operating lever 7, which is slideably equipped with lock base 3 to allow lock pin 5 to be placed at an unlocking position, is provided with a bifurcated fork 34 made of a metal such as aluminum, a boss 35 formed by it being bent at the midpoint thereof. A semicircular shaped operating piece 36 of synthetic resin is integrally made on the upper part of the fork 34. The fork 34 and boss 35 of operating lever 7 are inserted into an insertion hole 28 of lock base 3. A tip of the fork 34 is positioned at the front side of brim piece 32 over lock pin 5, and boss 35 is pivotably fitted in the axial direction of lock base 3 around a supporting axis 37.

The coming-off prevention and holding means 8, which allows lock pin 5 to be placed at a locking position for coming-off prevention and holding (locked safety position) and is installed, with this example, between lock base 3 and lock pin 5, is provided with lock pin 5 movable in the longitudinal direction relative to lock base 3 and pivotally moveable about the axis. A rotation operating body 38 is installed on lock pin 5 to rotate the lock pin 5. A rotation regulating mechanism 39 is installed between lock base 3 and lock pin 5 to regulate rotation of lock pin 5, thus allowing lock pin 5 to be placed in a coming-off prevention capable position (locked safety position) or in a coming-off prevention incapable position (operational orientation). A coming-off prevention mechanism 40 is installed between lock base 3 and lock pin 5 to prevent lock pin 5 from moving in the longitudinal direction when lock pin 5 is in the safety position, and allows lock pin 5 to move in the longitudinal direction when lock pin 5 is in the coming-off prevention incapable position (operational orientation).

Figure 2:
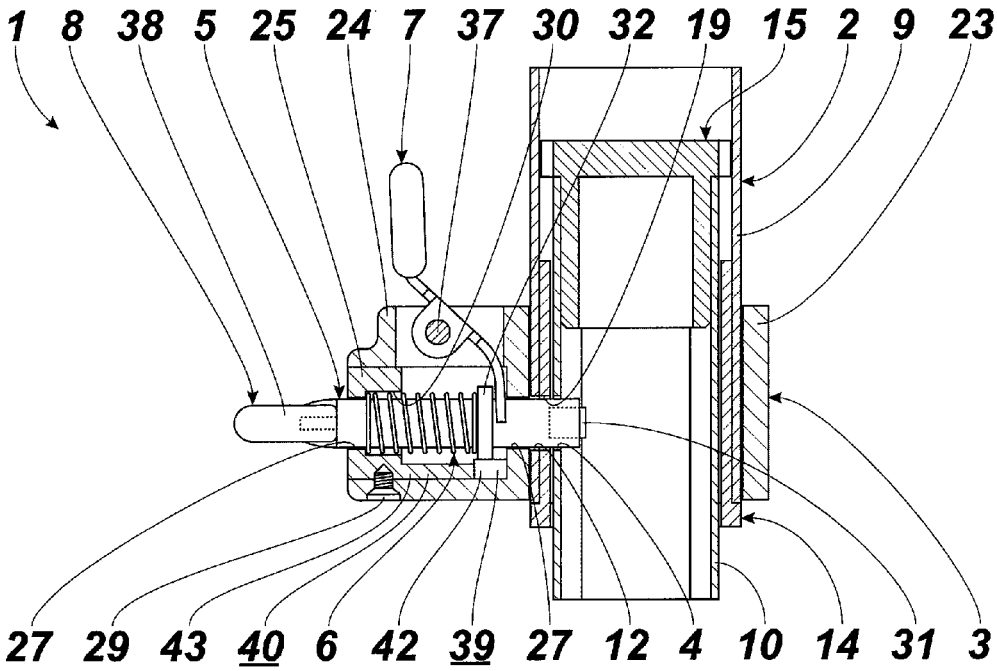
FIG. 2 is a longitudinal sectional side view to illustrate the state of coming-off prevention being released and locked (operational orientation).
Figure 3:
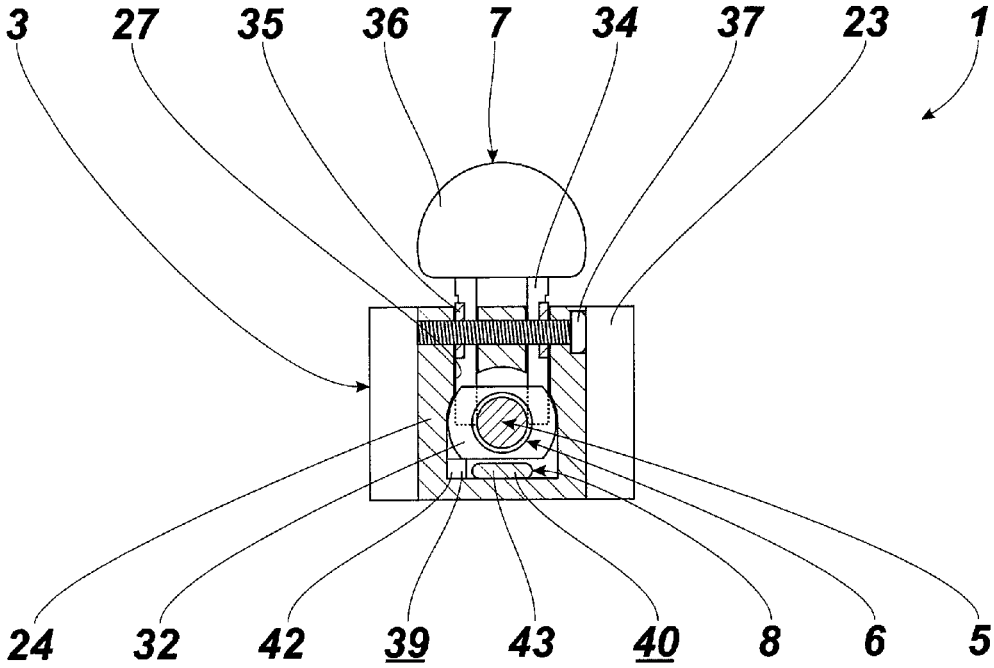
FIG. 3 is a longitudinal sectional rear view of FIG. 2.
Figure 4:
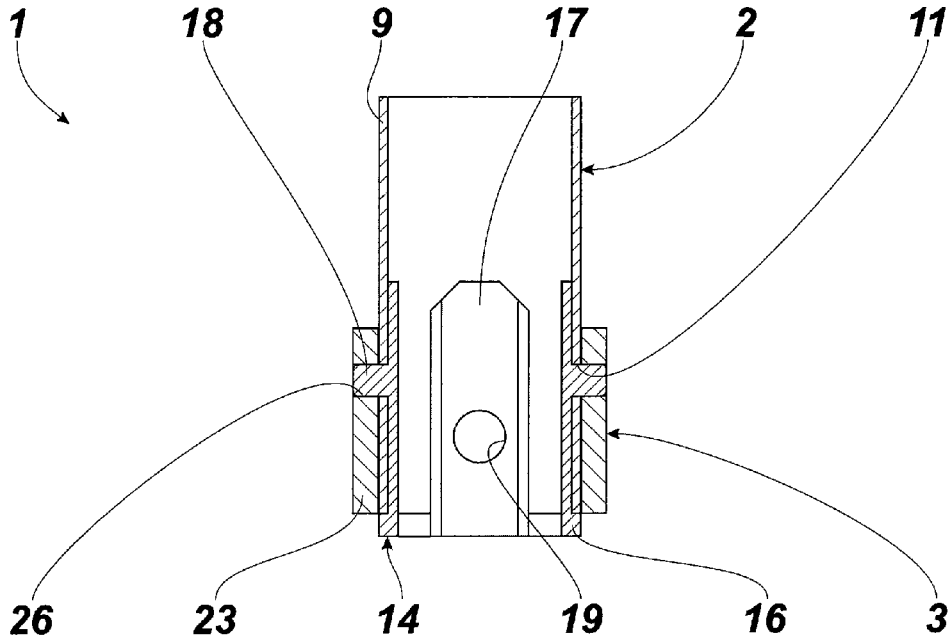
FIG. 4 is a longitudinal sectional front view to illustrate how the outer pipe of the pole, the lock base and the outer pipe side sliding body fit together.
Figure 5:
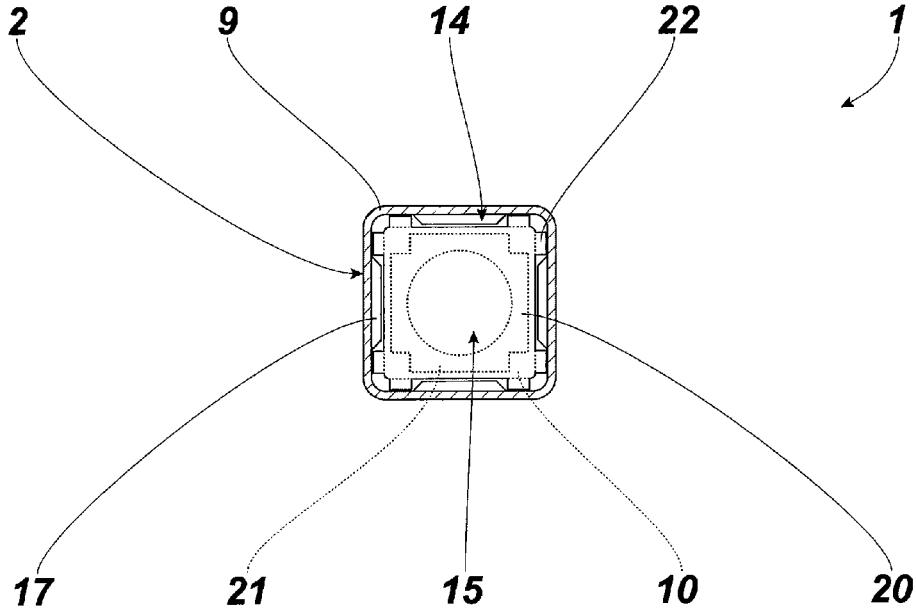
FIG. 5 is a cross sectional top plan view to illustrate how the outer and inner pipes of the pole fit together.
Figure 7:
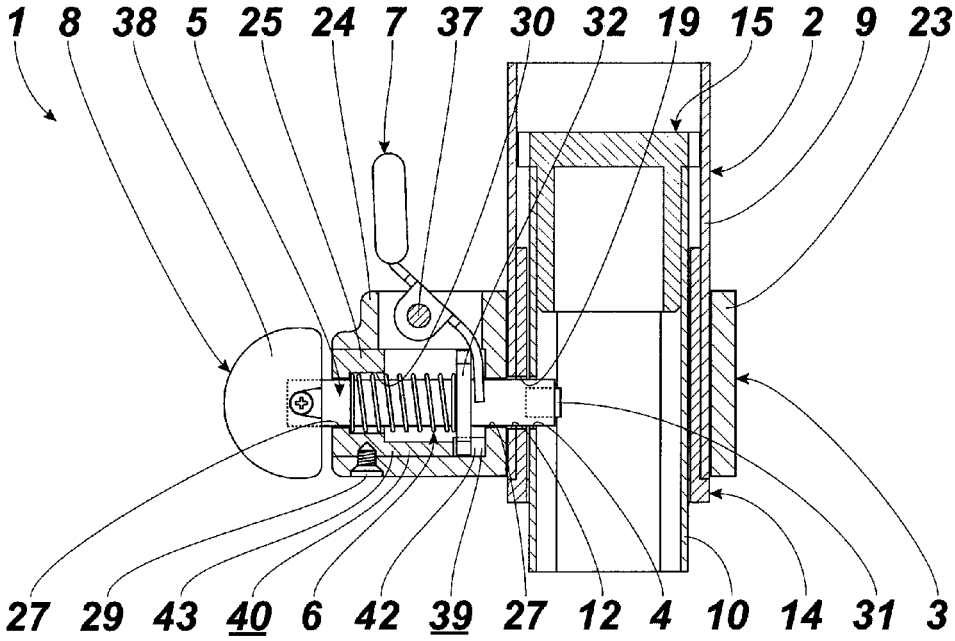
FIG. 7 is the same view as FIG. 2 to illustrate the state of coming-off prevention being held and locked (the locked safety position).

A synthetic resin made and semicircle shaped rotation operating body 38 is provided with a receiving hole on the front side thereof, whereto fitting piece 33 of lock pin 5 is inserted and is removably secured by a fixture 41 such as a screw or the like. The rotation regulating mechanism 39 is provided with brim piece 32 of lock pin 5 and a rotational stop 42 provided inside the case 24 of lock base 3, thus allowing rotational regulating mechanism 39 to be contacted with the end surface of the brim piece 32 when lock pin 5 is in the coming-off prevention capable position (locked safety position), and also in the coming-off prevention incapable position (operational orientation). The prism shaped rotational stop 42 is formed on the lower left corner of the front side in the case 24 of lock base 3. The coming-off prevention mechanism 40 includes brim piece 32 of lock pin 5 and a coming-off prevention piece 43 installed on the lock base 3. The coming-off prevention piece 43 blocks brim piece 32 when lock pin 5 is at the coming-off prevention capable position (locked safety position), preventing the lock pin 5 from moving from the locking position to the unlocking position; coming-off prevention piece 43 makes no contact with a brim piece 32 when lock pin 5 is at the coming-off prevention incapable position (operational orientation). The plate shaped coming-off prevention piece 43 projects forward from the front lower side of the cap 25 of lock base 3. As shown in FIG. 2, a rotation operating body 38 is made so that when, in a horizontal state, the brim piece 32 of lock pin 5 comes to be in a horizontal state, thus the lock pin 5 is placed in the coming-off prevention incapable position (operational orientation) by means of the rotation regulating mechanism 39. When the rotation operating body is rotated 90° clockwise, as shown in FIG. 3, to be in a vertical state, as shown in FIG. 7, the brim piece 32 of lock pin 5 come to be in a vertical state, thus lock pin 5 is placed in a coming-off prevention capable position (locked safety position) by means of rotation regulating mechanism 39.

Next, functions are described based on such a constitution.

A locking device for a tent 1 is assembled in such a manner as described below. A fork 34 and a boss 35 of an operating lever 7 are inserted into an insertion hole 28 of a lock base 3. The boss 35 is slideably fitted to the lock base 3 with a supporting axis 37. An elastic body 6 is inserted onto a rear half of a lock pin 5. After the rear side of lock pin 5 is inserted into a guide hole 27 of a cap 25 of lock base 3, a rotation operating body 38 is fitted to a fitting piece 33 of lock pin 5 by means of a fixture 41. The lock pin 5 is then inserted into a case 24 of lock base 3 so that lock pin 5 is inserted into guide hole 27 of a pipe 23 of lock base 3. The cap 25 of lock base 3 is fixed to case 24 by means of a fastener 29, thus fork 34 of operating lever 7 makes contact with the front side of a brim piece 32 in the state of crossing over the front side of lock pin 5.

The locking device for a tent 1 assembled in such a manner is fitted to an outer pipe 9 of a pole 2 as follows. The lock pin 5 is placed at an unlocking position as operating lever 7 is slid to the front side, pipe 23 of lock base 3 is slipped over the lower part of outer pipe 9 of the pole; a fitting hole 11 of outer pipe 9 and a fitting hole 26 of lock base 3 come into alignment, and a through hole 12 of outer pipe 9 and guide hole 27 of lock base 3 come into alignment. When a sliding piece 17 equipped with a projection 18 of an outer pipe side sliding body 14 is made narrow and inserted in the lower part of outer pipe 9, projection 18 of outer pipe side sliding body 14 is fitted to fitting hole 11 of outer pipe 9 and fitting hole 26 of lock base 3 with an elastic restoring force. The through hole 12 of outer pipe 9 and a through hole 19 of outer pipe side sliding body 14 come into alignment, thus allowing lock pin 5 to project through the inside of outer pipe side sliding body 14 by way of the through holes 12 and 19. An inner pipe side sliding body 15 is fitted by means of an inserting piece 21 being slipped onto the upper part of an inner pipe 10.

When a lock hole 4 and lock pin 5 are made to come into alignment by performing a relative hoisting/lowering of inner pipe 10 of pole 2 and lock base 3, a relative hoisting/lowering of inner pipe 10 of pole 2 and lock base 3 is prevented because lock pin 5 is inserted into lock hole 4, with the help of an elastic body 6, to be at a lock position (see FIG. 2 and FIG. 3). When lock hole 4 and lock pin 5 do not come into alignment, a sliding piece 31 of lock pin 5 makes contact with the outer surface of inner pipe 10, thus avoiding damage to the inner pipe 10.

Figure 6:
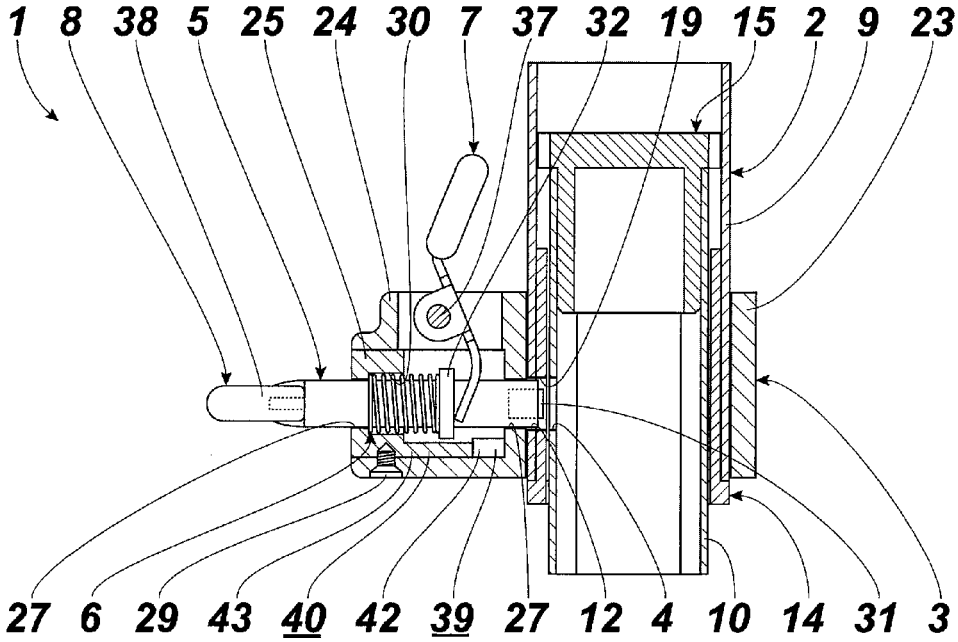
FIG. 6 is the same view as FIG. 2 to illustrate the state of being unlocked.

When operating lever 7 is slid against the force of elastic body 6 towards the front side from such a state, that is, when operating lever 7 is rotated clockwise about the supporting axis 37 as shown in FIG. 2, lock pin 5 comes out of lock hole 4, thus placing lock pin 5 in an unlocking position, and a relative hoisting/lowering of inner pipe 10 of pole 2 and lock base 3 is allowed (see FIG. 6).

Figure 8:
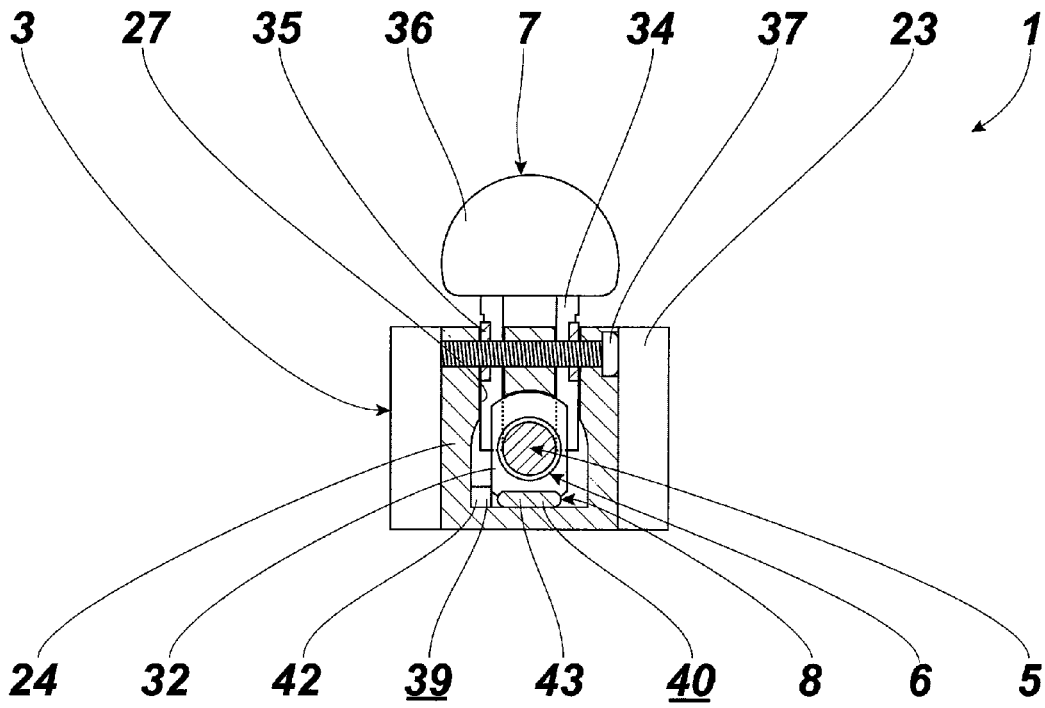
FIG. 8 is a longitudinal sectional rear view of FIG. 7.

When a rotation operating body 38 of coming-off prevention and holding means 8 is in a horizontal state, brim piece 32 of lock pin 5 is also in a horizontal state, thus lock pin 5 is placed in a coming-off prevention incapable position (operational orientation) by means of rotation regulating mechanism 39. Then, when operating lever 7 is manipulated, lock pin 5 is placed at an unlocking position (see FIG. 2 and FIG. 3). However, when a rotation operating body 38 of coming-off prevention and holding means 8 is turned to a vertical position by rotating it by 90° from the horizontal position, lock pin 5 is placed in a coming-off prevention capable position (locked safety position) by means of rotation regulating mechanism 39 because brim piece 32 of lock pin 5 becomes vertical. Then, even when operating lever 7 is pressed, lock pin 5 remains held at a locking position (see FIG. 7 and FIG. 8).

Being equipped with coming-off prevention and holding means 8, even when lock pin 5 has a force applied towards the unlocking position by accidental manipulation of operating lever 7, any relative hoisting/lowering of inner pipe 10 of pole 2 relative to lock base 3 is prevented because lock pin 5 is held in a locking position for coming-off prevention and holding (locked safety position) by means of coming-off prevention and holding means 8. The coming-off prevention and holding means 8 for which lock pin 5 is used makes its structure simplified so that cost reduction and space saving can be achieved. The brim piece 32 of lock pin 5 has extremely rational roles, one to transmit an operating force of operating lever 7 to lock pin 5, and the other to receive the one side of an elastic body and another to comprise some parts of the rotation regulating mechanism 39 and coming-off prevention mechanism 40. It is also extremely rational that lock base 3 is removably fitted to outer pipe 9 of pole 2 by making use of outer pipe side sliding body 14.

With the previous example, lock base 3 is fixed to outer pipe 9, lock hole 4 is installed on inner pipe 10, and through hole 12 through which lock pin 5 passes is made in outer pipe 9. However, it is possible that, for example, lock base 3 is fitted to outer pipe 9, and lock hole 4 is formed in the outer pipe 9. In such a manner, it becomes possible that a beam member for a tent (not illustrated) is fixed to lock base 3 and locking device 1 is installed between a pole and a beam member. With the previous example, a coil spring is employed. However, there is no need to say that, for example, a coil spring can be replaced by a flat board spring, rubber or the like. With the previous example, the coming-off prevention and holding means is installed between a lock base 3 and a lock pin 5. However, it is also possible that, for example, it is installed between lock base 3 and operating lever 7.

REFERENCE NUMERALS

1 A locking device for a tent
2 A pole
3 A lock base
4 A lock hole
5 A lock pin
6 An elastic body
7 An operating lever
8 A coming-off prevention and holding means
9 An outer pipe
10 An inner pipe
11 A fitting hole
12 A through hole
13 A stiffening rib
14 An outer pipe side sliding body
15 An inner pipe side sliding body
16 A frame piece
17 A sliding piece
18 A projection
19 A through hole
20 A cap piece
21 An inserting piece

22 An sliding piece
23 A pipe
24 A case
25 A cap
26 A fitting hole
27 A guide hole
28 An insertion hole
29 Fastening hardware
30 A receiving hole
31 A sliding piece
32 A brim piece
33 A fitting piece
34 A fork
35 A boss
36 An operating piece
37 A supporting axis
38 A rotation operating body
39 A rotation regulating mechanism
40 A coming-off prevention mechanism
41 A fixture
42 A rotational stop
43 A coming-off prevention piece

The invention claimed is:

1. A locking device for a tent comprising:

(a) a pole having a lock hole;

(b) a lock base installed to be moveable upward and downward relative to the pole;

(c) a lock pin, provided to be movable relative to the lock base in a longitudinal direction, thus enabling the lock pin to move from a locking position in which the lock pin enters the lock hole to an unlocking position in which the lock pin is disposed away from the lock hole;

(d) an elastic body adapted to push the lock pin mounted on the lock base towards the locking position all the time, (e) an operating lever rotatably mounted on the lock base and adapted to move the lock pin to the unlocking position;

(f) a coming-off prevention and holding means adapted to place the lock pin in a locked safety position, whereby direct transition from the locked safety position to the unlocking position is prevented, wherein the coming-off prevention and holding means is installed between the lock base and the lock pin, and wherein the lock pin provided movably in the longitudinal direction to the lock base is also pivotally movable about an axis of the longitudinal direction;

(g) a rotation operating body provided on the lock pin, with which an operation of rotation becomes possible from outside;

(h) a rotation regulating mechanism provided between the lock pin and the lock base, with which the lock pin can be placed either in the locked safety position or in an operational orientation by regulating the rotation of the lock pin; and (i) a coming-off prevention mechanism provided between the lock pin and the lock base, wherein the coming-off prevention mechanism prevents the lock pin from moving in the longitudinal direction when the lock pin is in the locked safety position, but also allows the lock pin to move in the longitudinal direction when the lock pin is in the operational orientation, wherein the rotation regulating mechanism comprises i. an oval shaped brim piece disposed on the lock pin; and ii. a rotational stop disposed on the lock base, wherein the rotational stop makes contact with an end surface of the brim piece when the lock pin is in the locked safety position and when the lock pin is in the operational orientation, and wherein the coming-off prevention mechanism includes i. the brim piece of the rotation regulating mechanism; and ii. a coming-off prevention piece mounted on the lock base, wherein the coming-off prevention mechanism allows the lock pin to engage the coming-off prevention piece with the brim piece when the lock pin is in the locked safety position and prevents the lock pin from engaging the coming-off prevention piece with the brim piece when the lock pin is in the operational orientation.

2. The locking device for a tent as claimed in claim 1:

wherein the pole comprises an outer pipe and an inner pipe to be fitted therein;

wherein the lock base is fixed to the outer pipe;

wherein the lock hole exists in the inner pipe; and wherein the outer pipe has a through hole through which the lock pin passes.

3. The locking device for a tent as claimed in claim 2, wherein an outer pipe side sliding body to slideably guide the inner pipe is provided on the lower part of the outer pipe, and wherein the lock base is removably fitted on the lower part of the outer pipe by means of the outer pipe side sliding body.

* * * * *